US012442129B2

(12) United States Patent
Song et al.

(10) Patent No.: US 12,442,129 B2
(45) Date of Patent: Oct. 14, 2025

(54) METHOD FOR DETERMINING BLOCKAGE OF FILTER MESH OF CLOTHES DRYER, DETERMINING APPARATUS, AND CLOTHES DRYER

(71) Applicants: HAIER SMART HOME CO., LTD., Shandong (CN); QINGDAO HAIER WASHING MACHINE CO., LTD., Shandong (CN)

(72) Inventors: Yijun Song, Shandong (CN); Longping Yao, Shandong (CN); Zhaobin Du, Shandong (CN); Hongbiao Ma, Shandong (CN); Jun Xia, Shandong (CN); Xinfeng Zhao, Shandong (CN)

(73) Assignees: HAIER SMART HOME CO., LTD., Shandong (CN); QINGDAO HAIER WASHING MACHINE CO., LTD., Shandong (CN)

( * ) Notice: Subject to any disclaimer, the term of this patent is extended or adjusted under 35 U.S.C. 154(b) by 321 days.

(21) Appl. No.: 18/264,723

(22) PCT Filed: Jan. 27, 2022

(86) PCT No.: PCT/CN2022/074363
§ 371 (c)(1),
(2) Date: Aug. 8, 2023

(87) PCT Pub. No.: WO2022/170992
PCT Pub. Date: Aug. 18, 2022

(65) Prior Publication Data

US 2024/0117561 A1 Apr. 11, 2024

(30) Foreign Application Priority Data

Feb. 9, 2021 (CN) ..... 202110181180.8

(51) Int. Cl.
*D06F 58/50* (2020.01)
*D06F 34/18* (2020.01)
(Continued)

(52) U.S. Cl.
CPC ..... *D06F 58/50* (2020.02); *D06F 34/18* (2020.02); *D06F 34/20* (2020.02); *D06F 58/22* (2013.01);
(Continued)

(58) Field of Classification Search
None
See application file for complete search history.

(56) References Cited

U.S. PATENT DOCUMENTS 7,926,201 B2 * 4/2011 Kim ..... D06F 34/20 15/300.1
8,627,525 B2 * 1/2014 Jurmann ..... D06F 33/48 68/3 R
(Continued)

FOREIGN PATENT DOCUMENTS

CN 111101357 5/2020
CN 111218793 6/2020
(Continued)

OTHER PUBLICATIONS

Extended European Search Report, EP22752153.1, mailed on Jan. 8, 2025.
(Continued)

*Primary Examiner* — Peter J Macchiarolo
*Assistant Examiner* — Jermaine L Jenkins
(74) *Attorney, Agent, or Firm* — Greenberg Traurig

(57) ABSTRACT

Provided are a method and apparatus for determining a blockage of a filter of a clothes dryer and a clothes dryer. The clothes dryer includes a motor. The method includes following steps. An actual rotational speed of the motor is
(Continued)

acquired, and an electrical parameter corresponding to a rotational speed range to which the actual rotational speed belongs is determined as a first threshold corresponding to the actual rotational speed; an actual clothes volume in the clothes dryer is acquired, and the first threshold is corrected according to a correction coefficient corresponding to a clothes volume range to which the actual clothes volume belongs so that a second threshold is obtained; and an actual electrical parameter of the motor is acquired, and when it is detected that the actual electrical parameter is less than the second threshold, it is determined that the filter of the clothes dryer is blocked.

13 Claims, 3 Drawing Sheets

(51) Int. Cl.

| | |
|---|---|
| ***D06F 34/20*** | (2020.01) |
| ***D06F 58/22*** | (2006.01) |
| ***D06F 103/04*** | (2020.01) |
| ***D06F 103/24*** | (2020.01) |
| ***D06F 103/42*** | (2020.01) |
| ***D06F 103/46*** | (2020.01) |
| ***D06F 105/48*** | (2020.01) |
| ***D06F 105/58*** | (2020.01) |

(52) U.S. Cl.
CPC ..... *D06F 2103/04* (2020.02); *D06F 2103/24* (2020.02); *D06F 2103/42* (2020.02); *D06F 2103/46* (2020.02); *D06F 2105/48* (2020.02); *D06F 2105/58* (2020.02)

(56) References Cited

U.S. PATENT DOCUMENTS

| | | | | |
|---|---|---|---|---|
| 9,052,142 | B2 * | 6/2015 | Kim | F26B 21/003 |
| 2013/0139402 | A1 | 6/2013 | Hong | |

FOREIGN PATENT DOCUMENTS

| | | | | |
|---|---|---|---|---|
| DE | 102013108783 | | 2/2015 | |
| JP | 2000102700 | | 4/2000 | |
| JP | 2010188034 | | 9/2010 | |
| JP | 2010259603 | | 11/2010 | |
| JP | 2013022225 | | 2/2013 | |
| JP | 2019042411 | | 3/2019 | |
| KR | 20060033255 | A * | 4/2006 | D06F 58/50 |

OTHER PUBLICATIONS

International Search Report, PCT/CN2022/074363, mailed on Mar. 29, 2022.

* cited by examiner

METHOD FOR DETERMINING BLOCKAGE OF FILTER MESH OF CLOTHES DRYER, DETERMINING APPARATUS, AND CLOTHES DRYER

This application is a National Stage Application filed under 35 U.S.C. 371 based on International Patent Application No. PCT/CN2022/074363, filed on Jan. 27, 2022, which claims priority to Chinese Patent Application No. 202110181180.8 filed with the China National Intellectual Property Administration (CNIPA) on Feb. 9, 2021, the disclosures of which applications are incorporated herein by reference in their entirety.

TECHNICAL FIELD

Embodiments of the present application relate to the technical field of clothes dryers, for example, a method and apparatus for determining a blockage of a filter of a clothes dryer and a clothes dryer.

BACKGROUND

With the progress of technologies and the improvement of living standards, smart home devices such as clothes dryers have been widely used in real life. However, a serious blockage of the filter of the clothes dryer will prolong the drying time and reduce the drying efficiency, resulting in energy waste.

A heat pump clothes dryer determines the blockage of the filter according to that the temperature of exhaust and the temperature of condenser outlet are too close, and an electric heating condensing clothes dryer determines the blockage of the filter according to that the temperature of a temperature sensor of a heater accessory rises too fast or reaches a relatively high limit several times in a short time. Since the temperature rises over time, a certain degree of hysteresis exists, so that the determination according to the change in the temperature caused by the blockage of the filter has low timeliness and can easily be inaccurate.

Therefore, the problem exists in the related art that low timeliness and inaccurate determination occurs when the clothes dryer determines the blockage of the filter according to the change in the temperature.

SUMMARY

Embodiments of the present application provide a method and apparatus for determining a blockage of a filter of a clothes dryer and a clothes dryer, so that the problem in the related art that low timeliness and inaccurate determination occurs when the clothes dryer determines the blockage of the filter according to the change in the temperature is solved.

In a first aspect, an embodiment of the present application provides a method for determining a blockage of a filter of a clothes dryer, where the clothes dryer includes a motor. The method includes steps described below.

An actual rotational speed of the motor is acquired, and an electrical parameter corresponding to a rotational speed range to which the actual rotational speed belongs is determined as a first threshold corresponding to the actual rotational speed.

An actual clothes volume in the clothes dryer is acquired, and the first threshold is corrected according to a correction coefficient corresponding to a clothes volume range to which the actual clothes volume belongs so that a second threshold is obtained.

An actual electrical parameter of the motor is acquired, and when it is detecting that the actual electrical parameter is less than the second threshold, determining that the filter of the clothes dryer is blocked.

Optionally, the actual electrical parameter of the motor includes an actual phase current.

Alternatively, the actual electrical parameter of the motor includes actual power calculated according to an actual phase current of the motor.

Optionally, before the actual rotational speed of the motor is acquired, steps described below are further included.

It is set that from a first clothes volume range to an N-th clothes volume range, a clothes volume within a front level of clothes volume range is smaller than a clothes volume within a rear level of clothes volume range, where N is an integer greater than 1.

It is set that each clothes volume range from the first clothes volume range to the N-th clothes volume range corresponds to a correction coefficient k.

Optionally, the second threshold is equal to the first threshold multiplied by the correction coefficient, where k is greater than or equal to 0 and is less than or equal to 1, and a correction coefficient corresponding to the front level of clothes volume range is greater than a correction coefficient corresponding to the rear level of clothes volume range.

Optionally, the second threshold is equal to the sum of the first threshold and the correction coefficient, where k is less than or equal to 0, and a correction coefficient corresponding to the front level of clothes volume range is greater than a correction coefficient corresponding to the rear level of clothes volume range.

Optionally, the step in which the actual clothes volume in the clothes dryer is acquired includes steps described below.

A clothes water content and a clothes weight in the clothes dryer are collected.

The actual clothes volume in the clothes dryer is determined according to the clothes water content and the clothes weight.

Optionally, before the actual rotational speed of the motor is acquired, steps described below are further included.

It is set that from a first rotational speed range to an M-th rotational speed range, a rotational speed within a front level of rotational speed range is less than a rotational speed within a rear level of rotational speed range, where M is an integer greater than 1.

It is set that each rotational speed range from the first rotational speed range to the M-th rotational speed range corresponds to an electrical parameter, and an electrical parameter corresponding to the front level of rotational speed range is less than an electrical parameter corresponding to the rear level of rotational speed range.

Optionally, the second threshold is greater than a first reference electrical parameter and less than a second reference electrical parameter, the first reference electrical parameter is an electrical parameter of the motor when the clothes dryer operates in the rotational speed range with full load, and the second reference electrical parameter is an electrical parameter of the motor when the clothes dryer operates in the rotational speed range with no load.

Optionally, after it is detected that the actual electrical parameter is less than the second threshold, steps described below are further included.

The actual rotational speed of the motor is switched to a rear level of rotational speed range, an electrical parameter corresponding to the rear level of rotational speed range is determined as a new first threshold, and the new first threshold is corrected so that a new second threshold is obtained.

A total number of times that the actual electrical parameter is less than the second threshold is counted.

In a case where the total number of times is greater than a number threshold of times within set time duration, it is determined that the filter of the clothes dryer is blocked.

Optionally, after it is determined that the filter of the clothes dryer is blocked, the step described below is further included. A filter blockage alarm is sent.

In a second aspect, an embodiment of the present application provides an apparatus for determining a blockage of a filter of a clothes dryer, where the clothes dryer includes a motor. The apparatus includes a control module, a drive module and a clothes detection module.

The drive module is electrically connected to the motor, and the drive module is configured to acquire an actual rotational speed of the motor and an actual electrical parameter of the motor.

The clothes detection module is electrically connected to the control module, and the clothes detection module is configured to acquire an actual clothes volume in the clothes dryer, and send the actual clothes volume to the control module.

The control module is electrically connected to the drive module, and the control module is configured to acquire the actual rotational speed of the motor and the actual electrical parameter of the motor which are sent by the drive module, determine an electrical parameter corresponding to a rotational speed range to which the actual rotational speed belongs as a first threshold corresponding to the actual rotational speed, acquire the actual clothes volume in the clothes dryer sent by the clothes detection module, correct the first threshold according to a correction coefficient corresponding to a clothes volume range to which the actual clothes volume belongs to obtain a second threshold, and determine that the filter of the clothes dryer is blocked when detecting that the actual electrical parameter is less than the second threshold.

In a third aspect, an embodiment of the present application provides a clothes dryer. The clothes dryer includes a motor and the preceding determining apparatus.

In a fourth aspect, an embodiment of the present application further provides a non-transitory computer-readable storage medium storing a computer program which, when executed by a processor, implements the method for determining a blockage of a filter of a clothes dryer provided in any of the preceding embodiments.

DETAILED DESCRIPTION

Embodiment One

Figure 1:
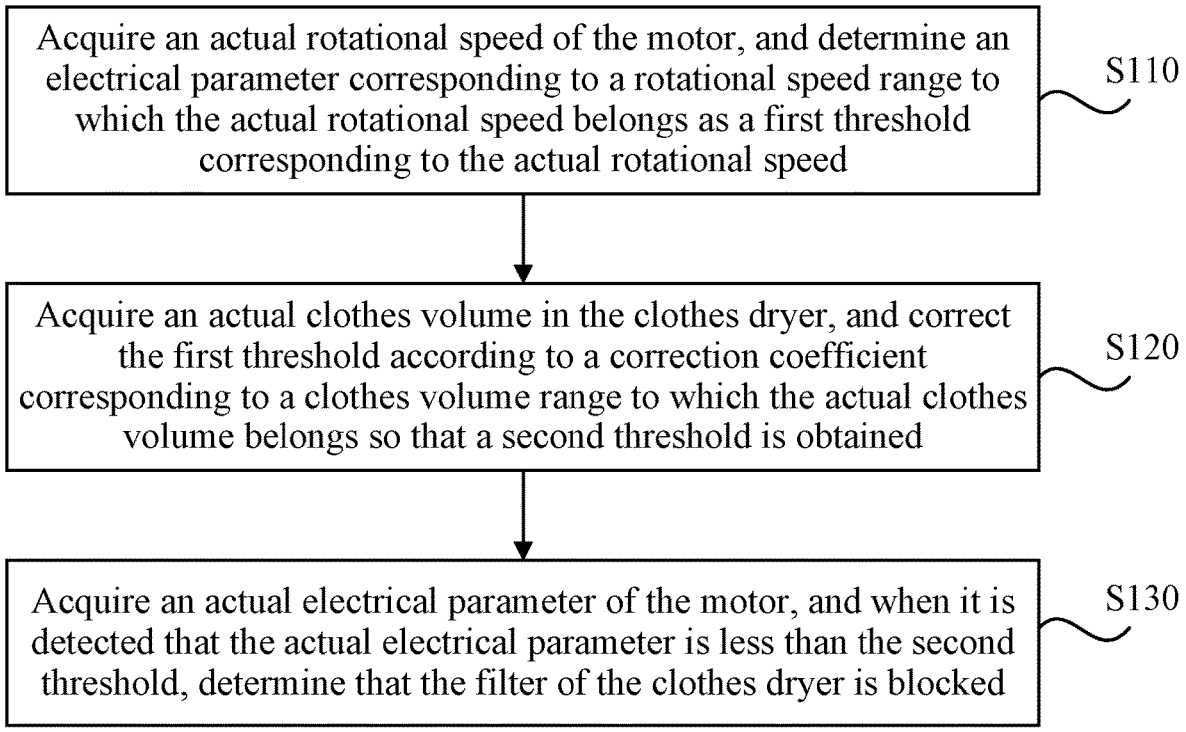
FIG. 1 is a flowchart of a method for determining a blockage of a filter of a clothes dryer according to embodiment one of the present application.

FIG. 1 is a flowchart of a method for determining a blockage of a filter of a clothes dryer according to embodiment one of the present application. The technical solutions of the embodiment are applicable to the case of accurately and efficiently determining a blockage of a filter of a clothes dryer. The method may be executed by an apparatus for determining a blockage of a filter of a clothes dryer according to any embodiment of the present application. The apparatus may be implemented by software and/or hardware and may be integrated into a clothes dryer.

TABLE 1

| Filter condition | Rotational speed (revolutions per minute (rpm)) | No load (0 kilogram (0 kg)) Power (watt (W)) | Full load (9 kg) Power (W) |
|---|---|---|---|
| Cleanwed filter | 1800 | 25 | 18 |
| | 2000 | 35 | 28 |
| | 2200 | 49 | 41 |
| | 2400 | 66 | 60 |
| Half-blocked filter | 1800 | 16 | 15 |
| | 2000 | 25 | 24 |
| | 2200 | 35 | 33 |
| | 2400 | 48 | 50 |
| Fully-blocked filter | 1800 | 4 | 0 |
| | 2000 | 5 | 4 |
| | 2200 | 8 | 6 |
| | 2400 | 11 | 9 |

The clothes dryer provided in the embodiment of the present application includes a motor. As shown in FIG. 1, the method for determining a blockage of a filter of a clothes dryer includes steps described below.

In S110, an actual rotational speed of the motor is acquired, and an electrical parameter corresponding to a rotational speed range to which the actual rotational speed belongs is determined as a first threshold corresponding to the actual rotational speed.

The blockage of the filter directly affects the air circulation in the clothes dryer, and then affects the electrical parameter of the motor driving a fan to rotate. Whether the filter is blocked can be directly determined through the electrical parameter of the motor, which is accurate and efficient. Table 1 is a table showing relationships between the rotational speed of the motor, the power of the motor, the clothes parameter and the filter condition provided in the embodiment of the present application. Through the table, it can be seen that at the same rotational speed, the power of the motor decreases significantly after the filter is blocked. Therefore, whether the filter is blocked can be determined by monitoring the electrical parameter such as a phase current or the power of the motor.

The actual rotational speed of the motor is acquired, the actual rotational speed is divided into a corresponding rotational speed range, and the electrical parameter of the motor, such as the phase current or the power, set corresponding to the rotational speed range is determined as the first threshold corresponding to the actual rotational speed of the motor. In the embodiment of the present application, the first threshold corresponding to a rotational speed range is the electrical parameter of the motor corresponding to the rotational speed range when the filter is seriously blocked.

The worker may set the first threshold according to actual requirements, which is not limited in the embodiment of the present application. For example, if the blockage area of the filter is 70%, the filter is seriously blocked, and thus the electrical parameter of the motor can be used as the first threshold when the blockage area of the filter is 70%.

In S120, an actual clothes volume in the clothes dryer is acquired, and the first threshold is corrected according to a correction coefficient corresponding to a clothes volume range to which the actual clothes volume belongs so that a second threshold is obtained.

The motor drives the fan to rotate. When the fan is rotated, the air circulation is formed in a drum of the clothes dryer. The electrical parameter of the motor is also correlated with the air volume in the drum of the clothes dryer. The smaller the air volume in the drum, the lower the power of the motor. Therefore, the setting of an electrical parameter threshold (that is, the first threshold) needs to comprehensively consider the rotational speed of the motor and the air volume in the drum of the clothes dryer. The air volume in the drum is negatively correlated with the clothes volume in the drum. The larger the clothes volume, the smaller the air volume. With continued reference to Table 1, the power of the motor is also correlated with the clothes parameter in the clothes dryer, such as a clothes weight, that is, the clothes volume. The larger the clothes weight, the larger the corresponding clothes volume, and the smaller the air volume in the drum. Therefore, after the electrical parameter threshold, that is, the first threshold, is determined according to the actual rotational speed of the motor, the actual clothes volume in the clothes dryer may be used as a monitoring parameter, and the first threshold is corrected through the monitoring parameter so that a new electrical parameter threshold, that is, the second threshold, is obtained; thus, the accuracy of determining the blockage of the filter is improved.

For example, the actual clothes volume in the clothes dryer is divided into a corresponding clothes volume range, and the correction coefficient set corresponding to the clothes volume range is used for correcting the first threshold so that the second threshold is obtained. The correction coefficient and the second threshold are not limited and may be set according to actual situations.

In S130, an actual electrical parameter of the motor is acquired, and when it is detected that the actual electrical parameter is less than the second threshold, it is determined that the filter of the clothes dryer is blocked.

Optionally, the actual electrical parameter of the motor includes an actual phase current; or the actual electrical parameter of the motor includes actual power calculated according to an actual phase current of the motor.

The actual electrical parameter of the motor, such as the actual phase current, can be acquired through a motor drive board in the clothes dryer, and the actual power can be calculated according to the actual phase current. If it is detected that the actual phase current of the motor or the actual power of the motor is less than the second threshold, it is determined that the filter of the clothes dryer is blocked; if it is detected that the actual phase current of the motor or the actual power of the motor is greater than or equal to the second threshold, it is determined that the filter of the clothes dryer is not blocked. It is to be noted that when the determination is performed based on the actual phase current of the motor, the effective value of the phase current is used. In addition, in the embodiment of the present application, since the blockage condition of the filter is determined according to the electrical parameter of the motor, if the fan in the clothes dryer shares a motor with other components, the acquired actual electrical parameter of the motor is affected by other components, leading to inaccurate detection. To improve the detection accuracy, the method for determining provided in the embodiment of the present application is more suitable for direct drive clothes dryers with an independent fan, that is, an internal circulation fan exclusively using a motor for driving, but not limited to such clothes dryers. The method for determining provided in the embodiment of the present application is applicable to both condensing clothes dryers and heat pump clothes dryers, and types of clothes dryers to which the method is applicable are not limited in the embodiment of the present application.

According to the method for determining a blockage of a filter of a clothes dryer provided in the embodiment of the present application, the actual rotational speed of the motor is acquired, and the electrical parameter corresponding to the rotational speed range to which the actual rotational speed belongs is determined as the first threshold corresponding to the actual rotational speed; the actual clothes volume in the clothes dryer is acquired, and the first threshold is corrected according to the correction coefficient corresponding to the clothes volume range to which the actual clothes volume belongs so that the second threshold is obtained; and the actual electrical parameter of the motor is acquired, and when it is detected that the actual electrical parameter is less than the second threshold, it is determined that the filter of the clothes dryer is blocked. According to the method for determining a blockage of a filter of a clothes dryer provided in the embodiment of the present application, the first threshold is first determined according to the rotational speed of the motor, then the first threshold is corrected according to the actual clothes volume in the clothes dryer so that the second threshold is obtained, that is, the electrical parameter threshold of the motor (the second threshold) is determined in combination with two parameters of the rotational speed of the motor and the clothes volume, and thus whether the filter is blocked is directly determined according to the electrical parameter of the motor. In this manner, determination can be performed within a few seconds or tens of seconds after the machine starts without being affected by the machine operation time and the internal environmental temperature, which is accurate and efficient.

Figure 2:
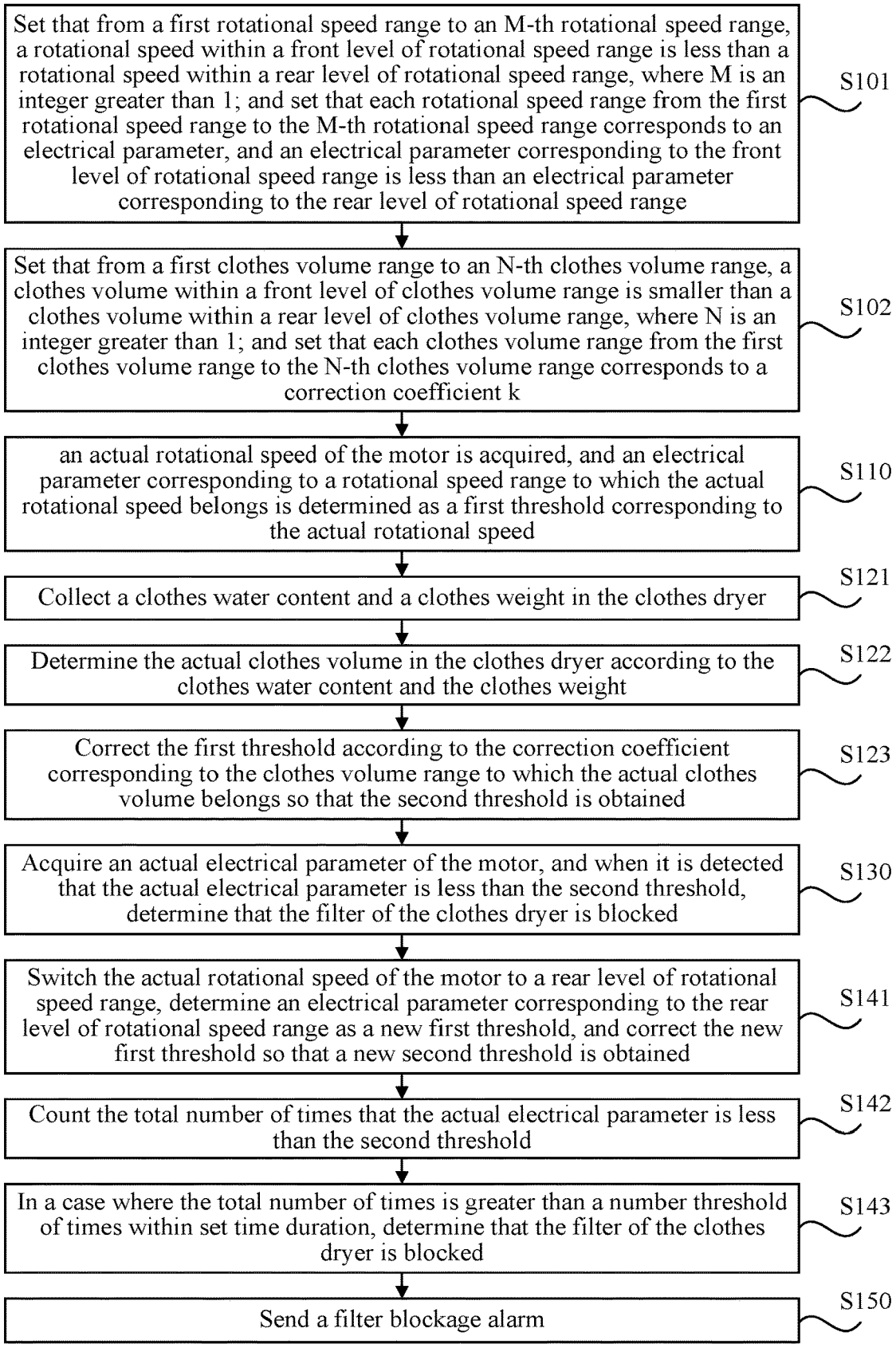
FIG. 2 is a flowchart of another method for determining a blockage of a filter of a clothes dryer according to embodiment one of the present application.

FIG. 2 is a flowchart of another method for determining a blockage of a filter of a clothes dryer according to embodiment one of the present application. Referring to FIG. 2, optionally, before step S110 in which the actual rotational speed of the motor is acquired, S102 is further included.

In S102, it is set that from a first clothes volume range to an N-th clothes volume range, a clothes volume within a front level of clothes volume range is smaller than a clothes volume within a rear level of clothes volume range, where N is an integer greater than 1; and it is set that each clothes volume range from the first clothes volume range to the N-th clothes volume range corresponds to a correction coefficient k.

The clothes volume in the clothes dryer will affect the electrical parameter of the motor; multiple levels of consecutive clothes volume ranges are established, and each clothes volume range corresponds to a correction coefficient k, so that the clothes volume in the clothes dryer can correspond to the correction coefficient k, and thus the first threshold can be corrected with the correction coefficient k. Different clothes volumes in the clothes dryer have different impacts on the electrical parameter of the motor, and the correction coefficient k is used for reflecting the correction extent, that is, the impact degree. The value of the correction coefficient k and the specific correction manner are not limited and may be set according to actual situations and requirements. The overall range of clothing volume ranges is not limited. The volume of the drum of the Clothes dryer may be used as the maximum value of the clothes volume for division of clothes volume ranges. Clothes volumes are divided into multiple levels of consecutive clothes volume ranges, which can simplify the data amount and save the storage space.

Optionally, the second threshold is equal to the first threshold multiplied by the correction coefficient k, where k is greater than or equal to 0 and is less than or equal to 1, and a correction coefficient corresponding to the front level of clothes volume range is greater than a correction coefficient corresponding to the rear level of clothes volume range.

It is set that when the clothes dryer is in a no-load state, and the filter is seriously blocked, for example, the blockage area is 60%, the electrical parameter of the motor is the electrical parameter corresponding to the rotational speed range; then when the clothes dryer is in a non-no-load state, as the clothes volume in the clothes dryer increases, the air volume in the drum of the clothes dryer decreases, and the electrical parameter of the motor decreases. Therefore, when the first threshold is corrected according to the manner that the second threshold=the first threshold×the correction coefficient, if the second threshold is to be less than or equal to the first threshold, k is greater than or equal to 0 and is less than or equal to 1. Since the clothes volume within the front level of clothes volume range is smaller than the clothes volume within the rear level of clothes volume range, for the setting of corresponding correction coefficients k, the correction coefficient corresponding to the front level of clothes volume range is greater than the correction coefficient corresponding to the rear level of clothes volume range.

Optionally, the second threshold is equal to the sum of the first threshold and the correction coefficient, where k is less than or equal to 0, and a correction coefficient corresponding to the front level of clothes volume range is greater than a correction coefficient corresponding to the rear level of clothes volume range.

The first threshold may also be corrected in the manner that the second threshold is equal to the sum of the first threshold and the correction coefficient. As the clothes volume in the clothes dryer increases, the electrical parameter of the motor decreases. Therefore, if the second threshold is to be less than or equal to the first threshold, k is less than or equal to 0. Since the clothes volume within the front level of clothes volume range is smaller than the clothes volume within the rear level of clothes volume range, for the setting of corresponding correction coefficients k, the correction coefficient corresponding to the front level of clothes volume range is greater than the correction coefficient corresponding to the latter level of clothes volume range.

Referring to FIG. 2, optionally, S120 in which the actual clothes volume in the clothes dryer is acquired, and the first threshold is corrected according to the correction coefficient corresponding to the clothes volume range to which the actual clothes volume belongs so that the second threshold is obtained includes S121.

In S121, a clothes water content and a clothes weight in the clothes dryer are collected.

Figure 3:
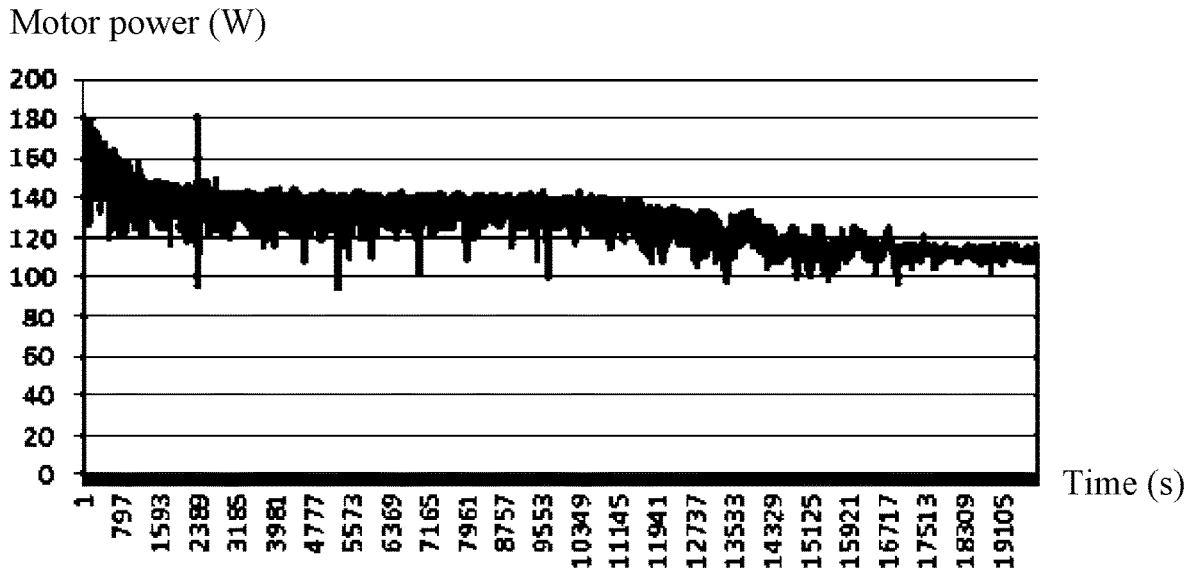
FIG. 3 is a schematic diagram of motor power changing with time in the drying process of a clothes dryer according to embodiment one of the present application.

FIG. 3 is a schematic diagram of motor power changing with time in the drying process of a clothes dryer according to embodiment one of the present application. As shown in FIG. 3, during the drying process, the motor power has a downward trend in general, which is because in the drying process, as the clothes continue to dry, the clothes become more and more fluffy, that is, the clothes volume increases, the air volume in the dryer decreases, and thus the power of the motor deceases. Therefore, the drying degree of the clothes will affect the clothes volume, and then affects the power of the motor. In addition, the larger the clothes weight, the larger the clothes volume; therefore, the clothes weight also affects the clothes volume, and then affects the power of the motor. Therefore, the clothes drying degree and the clothes weight may be used as two parameters to determine the clothes volume. The clothes drying degree may be obtained through the clothes water content detected by setting a temperature sensor or a humidity sensor in the clothes dryer, and the clothes weight may be obtained by setting a weight sensor. In summary, the clothes water content and the clothes weight in the clothes dryer may be acquired, and the actual clothes volume in the clothes dryer is obtained according to the clothes water content and the clothes weight.

In S122, the actual clothes volume in the clothes dryer is determined according to the clothes water content and the clothes weight.

A relationship database of the clothes water content and the clothes weight and the clothes volume may be established according to test statistical results. Based on the relationship database, the obtained clothes water content and the obtained clothes weight are matched with the actual clothes volume in the clothes dryer, and then the actual clothes volume is divided into the corresponding clothes volume range, so that the first threshold is corrected using the correction coefficient set corresponding to the clothes volume range and thus the second threshold is obtained, and then whether the filter is blocked is determined according to the size relationship between the actual electrical parameter of the motor and the second threshold.

In S123, the first threshold is corrected according to the correction coefficient corresponding to the clothes volume range to which the actual clothes volume belongs so that the second threshold is obtained.

Referring to FIG. 2, optionally, before step S110 in which the actual rotational speed of the motor is acquired, S101 is further includes.

In S101, it is set that from a first rotational speed range to an M-th rotational speed range, a rotational speed within a front level of rotational speed range is less than a rotational speed within a rear level of rotational speed range, where M is an integer greater than 1; and it is set that each rotational speed range from the first rotational speed range to the M-th rotational speed range corresponds to an electrical parameter, and an electrical parameter corresponding to the front level of rotational speed range is less than an electrical parameter corresponding to the rear level of rotational speed range.

Referring to the relationship table (Table 1) showing relationships between the rotational speed of the motor, the power of the motor, the clothes parameter and the filter condition provided in the embodiment of the present application, it can be seen from the table that when the motor is at different rotational speeds, the same filter condition corresponds to different electrical parameters of the motor. Therefore, before the actual rotational speed of the motor is acquired, a corresponding relationship between the rotational speed of the motor and the first threshold needs to be established. Similarly, to simplify the data amount and save the storage space, rotational speeds of the motor may be divided into multiple levels of consecutive rotational speed ranges. According to actual test and statistical results, an electrical parameter is set for each speed range, which is the electrical parameter of the motor corresponding to a severe blockage of the filter. In addition, the execution order of S101 and S102 is not limited; S102 may be executed first and then S101 is executed.

Optionally, the second threshold is greater than a first reference electrical parameter and less than a second reference electrical parameter. The first reference electrical parameter is an electrical parameter of the motor corresponding to the rotational speed range to which the actual rotational speed of the motor belongs when the clothes dryer operates with full load, and the second reference electrical parameter is an electrical parameter of the motor corresponding to the rotational speed range to which the actual rotational speed of the motor belongs when the clothes dryer operates with no load.

Due to the correlation between the electrical parameter of the motor and the rotational speed of the motor and the clothes volume, when whether the filter is blocked is determined according to the electrical parameter of the motor, the electrical parameter threshold of the motor, that is, the second threshold, is obtained by correcting the first threshold, which is determined according to the actual rotational speed of the motor, according to the actual clothes volume. That is, the second threshold is set in combination with two parameters, that is, the rotational speed and the clothes volume. Different clothes dryers have different full load conditions, that is, have different maximum values of the clothes volume range. Therefore, the second threshold should be greater than the electrical parameter of the motor corresponding to the rotational speed range to which the actual rotational speed of the motor belongs when the clothes dryer operates with full load, and less than the electrical parameter of the motor corresponding to the rotational speed range to which the actual rotational speed of the motor belongs when the clothes dryer operates with no load; that is, the second threshold should be between the first reference electrical parameter and the second reference electrical parameter.

Referring to FIG. 2, optionally, after S130 in which it is detected that the actual electrical parameter is less than the second threshold, S141, S142 and S142 are further included.

In S141, the actual rotational speed of the motor is switched to a rear level of rotational speed range, an electrical parameter corresponding to the rear level of rotational speed range is determined as a new first threshold, and the new first threshold is corrected so that a new second threshold is obtained.

If signal interference or motor failure occurs, wrong determination may be caused and the user experience is affected. To further improve the detection accuracy, after it is detected that the actual electrical parameter of the motor is less than the second threshold, the flow rate may be increased to continue drying by switching the rotational speed of the motor to the rear level of rotational speed range; the electrical parameter corresponding to the switched rotational speed range is used as the new first threshold, the first threshold value is corrected according to the actual clothes volume in the clothes dryer so that the new second threshold value is obtained, and then the process of determining the blockage of the filter is continued based on the new second threshold.

In S142, the total number of times that the actual electrical parameter is less than the second threshold is counted.

The preceding process is repeated. That is, after each time it is detected that the actual electrical parameter of the motor is less than the new second threshold, the rotational speed of the motor is continuously increased, determination is re-performed according to the new second threshold, and the total number of times that the actual electrical parameter of the motor is less than the second threshold is counted in the determination process.

In S143, in a case where the total number of times is greater than a number threshold of times within set time duration, it is determined that the filter of the clothes dryer is blocked.

Fixed time duration and a number threshold of times are set, for example, 20 minutes (20 min) and 6 times. If it is counted that the total number of times that the actual electrical parameter is less than the second threshold within 20 min is greater than 6 times, it is determined that the filter is blocked. The rotational speed of the motor is increased, and multiple times of processes of determining the blockage of the filter are performed according to the electrical parameter of the motor, so that the determination process can be optimized, the reliability of the determination result can be improved, and the user experience can be improved.

Optionally, after S130 in which it is determined that the filter of the clothes dryer is blocked, S150 is further included.

In S150, a filter blockage alarm is sent.

After it is determined that the filter of the clothes dryer is blocked, an alarm is sent in the manner of voice, display through a display screen or a phone prompt so that the user is reminded of cleaning the filter.

According to the method for determining a blockage of a filter of a clothes dryer provided in the embodiment of the present application, the first threshold is determined according to the rotational speed of the motor, and then the first threshold is corrected according to the actual clothes volume in the clothes dryer so that the second threshold is obtained, that is, the electrical parameter threshold of the motor determined in combination with two parameters, that is, the rotational speed of the motor and the clothes volume, is the second threshold, so that whether the filter is blocked is directly determined according to the electrical parameter of the motor, which is accurate and efficient. On this basis, through operations of determining the actual clothes volume in the clothes dryer according to the clothes water content and the clothes weight and determining multiple times whether the filter is blocked according to the electrical parameter of the motor in different manners such as correcting the first threshold according to the actual clothes volume and increasing the rotational speed of the motor, the determination process can be optimized, so that the reliability and the accuracy of the determination result are improved, and the user experience is improved.

Embodiment Two

Figure 4:
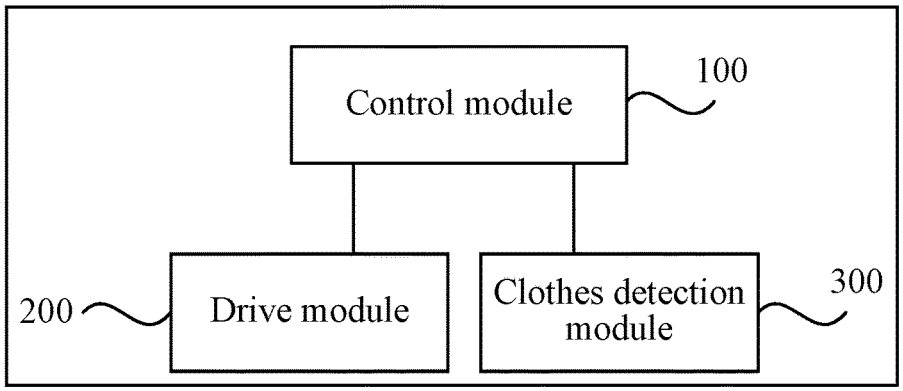
FIG. 4 is a structural diagram of an apparatus for determining a blockage of a filter of a clothes dryer according to embodiment two of the present application.

FIG. 4 is a structural diagram of an apparatus for determining a blockage of a filter of a clothes dryer according to embodiment two of the present application. The technical solutions of the embodiment are applicable to the case of accurately and efficiently determining a blockage of a filter of a clothes dryer. The apparatus may be implemented by software and/or hardware and may be integrated in a clothes dryer.

The clothes dryer provided in the embodiment of the present application includes a motor. As shown in FIG. 4, the apparatus for determining a blockage of a filter of a clothes dryer includes a control module 100, a drive module 200 and a clothes detection module 300. The drive module 200 is electrically connected to the motor, and the drive module 200 is configured to acquire an actual rotational speed of the motor and an actual electrical parameter of the motor. The clothes detection module 300 is electrically connected to the control module 100, and the clothes detection module is configured to acquire an actual clothes volume in the clothes dryer, and send the actual clothes volume to the control module 100. The control module 100 is electrically connected to the drive module 200, and the control module 100 is configured to acquire the actual rotational speed of the motor and the actual electrical parameter of the motor which are sent by the drive module 200, determine an electrical parameter corresponding to a rotational speed range to which the actual rotational speed belongs as a first threshold corresponding to the actual rotational speed, acquire the actual clothes volume in the clothes dryer sent by the clothes detection module 300, correct the first threshold according to a correction coefficient corresponding to a clothes volume range to which the actual clothes volume belongs to obtain a second threshold, and determine that the filter of the clothes dryer is blocked when detecting that the actual electrical parameter is less than the second threshold.

In the embodiment of the present application, the control module 100 may be a main control board in the clothes dryer, the drive module 200 may be a drive board in the clothes dryer, and the clothes detection module 300 may be a weight sensor, a temperature sensor or a humidity sensor, which is not specifically limited, as long as corresponding functions can be executed.

According to the apparatus for determining a blockage of a filter of a clothes dryer provided in the embodiment of the present application, the drive module acquires the actual rotational speed of the motor and the actual electrical parameter of the motor, the clothes detection module acquires the actual clothes volume in the clothes dryer, and the control module determines the first threshold according to the actual rotational speed of the motor, corrects the first threshold according to the actual clothes volume to obtain the second threshold, and determines that the filter of the clothes dryer is blocked when detecting that the actual electrical parameter is less than the second threshold, where an electrical parameter threshold (the second threshold) of the motor, is determined in combination with two parameters of the rotational speed of the motor and the clothes volume. In this manner, whether the filter is blocked is directly determined according to the electrical parameter of the motor, which is accurate and efficient.

Embodiment Three

Figure 5:
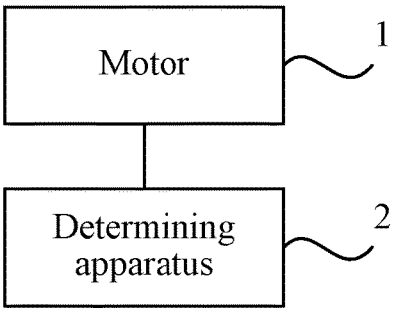
FIG. 5 is a structural diagram of a closes dryer according to embodiment three of the present application.

FIG. 5 is a structural diagram of a closes dryer according to embodiment three of the present application. The technical solutions of the embodiment are applicable to the case of accurately and efficiently determining a blockage of a filter of a clothes dryer.

As shown in FIG. 5, the clothes driver provided in the embodiment of the present application includes motor 1 and determining apparatus 2 provided in any embodiment of the present application.

According to the clothes dryer provided in the embodiment of the present application, the determining apparatus acquires an actual rotational speed of the motor, an actual electrical parameter of the motor and an actual clothes volume in the clothes dryer, determines a first threshold according to the actual rotational speed of the motor, corrects the first threshold according to the actual clothes volume to obtain a second threshold, and determines that a filter of the clothes dryer is blocked when detecting that the actual electrical parameter is less than the second threshold, where the second threshold, that is, an electrical parameter threshold of the motor, is determined in combination with two parameters, that is, the rotational speed of the motor and the clothes volume. In this manner, whether the filter is blocked is directly determined according to the electrical parameter of the motor, which is accurate and efficient.

An embodiment of the present application further provides a non-transitory computer-readable storage medium storing a computer program which, when executed by a processor, implements the method for determining a blockage of a filter of a clothes dryer provided in any of the preceding embodiments.

The computer-readable storage medium may be a transitory storage medium or a non-transitory storage medium.

What is claimed is:

1. A method for determining a blockage of a filter of a clothes dryer, wherein the clothes dryer comprises a motor, and the method comprises:

acquiring an actual rotational speed of the motor, and determining an electrical parameter corresponding to a rotational speed range as a first threshold corresponding to the actual rotational speed, wherein the actual rotational speed belongs to the rotational speed range;

acquiring an actual clothes volume in the clothes dryer, and correcting the first threshold according to a correction coefficient corresponding to a clothes volume range to obtain a second threshold, wherein the actual clothes volume belongs to clothes volume range; and acquiring an actual electrical parameter of the motor, and in response to detecting that the actual electrical parameter is less than the second threshold, determining that the filter of the clothes dryer is blocked.

2. The method according to claim 1, wherein the actual electrical parameter of the motor comprises an actual phase current; or the actual electrical parameter of the motor comprises actual power calculated according to an actual phase current of the motor.

3. The method according to claim 1, wherein before acquiring the actual rotational speed of the motor, the method further comprise:

setting N clothes volume ranges from a first clothes volume range to an N-th clothes volume range, wherein N is an integer greater than 1, and a clothes volume within a front level of clothes volume range is smaller than a clothes volume within a rear level of clothes volume range; and setting that each clothes volume range from the first clothes volume range to the N-th clothes volume range corresponds to a correction coefficient k.

4. The method according to claim 3, wherein the second threshold is equal to the first threshold multiplied by the correction coefficient, wherein k is greater than or equal to 0 and is less than or equal to 1, and a correction coefficient corresponding to the front level of clothes volume range is greater than a correction coefficient corresponding to the rear level of clothes volume range.

5. The method according to claim 3, wherein the second threshold is equal to a sum of the first threshold and the correction coefficient, wherein k is less than or equal to 0, and a correction coefficient corresponding to the front level of clothes volume range is greater than a correction coefficient corresponding to the rear level of clothes volume range.

6. The method according to claim 1, wherein acquiring the actual clothes volume in the clothes dryer comprises:

collecting a clothes water content and a clothes weight in the clothes dryer; and determining the actual clothes volume in the clothes dryer according to the clothes water content and the clothes weight.

7. The method according to claim 1, wherein before acquiring the actual rotational speed of the motor, the method further comprises:

setting M first rotational speed ranges from a first rotational speed range to an M-th rotational speed range, wherein M is an integer greater than 1, and a rotational speed within a front level of rotational speed range is less than a rotational speed within a rear level of rotational speed range; and setting that each rotational speed range from the first rotational speed range to the M-th rotational speed range corresponds to an electrical parameter, and an electrical parameter corresponding to the front level of rotational speed range is less than an electrical parameter corresponding to the rear level of rotational speed range.

8. The method according to claim 1, wherein the second threshold is greater than a first reference electrical parameter and less than a second reference electrical parameter, the first reference electrical parameter is an electrical parameter of the motor when the clothes dryer operates in the rotational speed range with full load, and the second reference electrical parameter is an electrical parameter of the motor when the clothes dryer operates in the rotational speed range with no load.

9. The method according to claim 1, wherein after detecting that the actual electrical parameter is less than the second threshold, the method further comprises:

switching the actual rotational speed of the motor to a rear level of rotational speed range, determining an electrical parameter corresponding to the rear level of rotational speed range as a new first threshold, and correcting the new first threshold to obtain a new second threshold;

counting a total number of times that the actual electrical parameter is less than the second threshold; and in a case where the total number of times is greater than a number threshold of times within set time duration, determining that the filter of the clothes dryer is blocked.

10. The method according to claim 1, wherein after determining that the filter of the clothes dryer is blocked, the method further comprises: sending a filter blockage alarm.

11. An apparatus for determining a blockage of a filter of a clothes dryer, wherein the clothes dryer comprises a motor, and the apparatus comprises a control module, a drive module and a clothes detection module; wherein the drive module is electrically connected to the motor, and the drive module is configured to acquire an actual rotational speed of the motor and an actual electrical parameter of the motor, the clothes detection module is electrically connected to the control module, and the clothes detection module is configured to acquire an actual clothes volume in the clothes dryer, and send the actual clothes volume to the control module; and the control module is electrically connected to the drive module, and the control module is configured to acquire the actual rotational speed of the motor and the actual electrical parameter of the motor which are sent by the drive module, determine an electrical parameter corresponding to a rotational speed range to which the actual rotational speed belongs as a first threshold corresponding to the actual rotational speed, acquire the actual clothes volume in the clothes dryer sent by the clothes detection module, correct the first threshold according to a correction coefficient corresponding to a clothes volume range to which the actual clothes volume belongs to obtain a second threshold, and determine that the filter of the clothes dryer is blocked in response to detecting that the actual electrical parameter is less than the second threshold.

12. A clothes dryer, comprising a motor and the apparatus according to claim 11.

13. A non-transitory computer-readable storage medium storing a computer program which, when executed by a processor, implements the method for determining a blockage of a filter of a clothes dryer, the method comprising:

acquiring an actual rotational speed of the motor, and determining an electrical parameter corresponding to a rotational speed range as a first threshold corresponding to the actual rotational speed, wherein the actual rotational speed belongs to the rotational speed range;

acquiring an actual clothes volume in the clothes dryer, and correcting the first threshold according to a correction coefficient corresponding to a clothes volume range to obtain a second threshold, wherein the actual clothes volume belongs to clothes volume range; and acquiring an actual electrical parameter of the motor, and in response to detecting that the actual electrical parameter is less than the second threshold, determining that the filter of the clothes dryer is blocked.

* * * * *